US007290898B2

(12) United States Patent
Martin et al.

(10) Patent No.: US 7,290,898 B2
(45) Date of Patent: Nov. 6, 2007

(54) PORTABLE AND MOBILE ILLUMINATION AND DETECTION

(75) Inventors: Roy Wallace Martin, Anacortes, WA (US); Brian Thomas Zender, Bellingham, WA (US); John Craig McCoy, Bellingham, WA (US); David James Albers, Bellingham, WA (US)

(73) Assignee: Biz Research Inc., Anacortes, Washington ( * ) Notice: Subject to any disclaimer, the term of this patent is extended or adjusted under 35 U.S.C. 154(b) by 227 days.

(21) Appl. No.: 11/097,740

(22) Filed: Mar. 31, 2005

(65) Prior Publication Data

US 2006/0221604 A1 Oct. 5, 2006

(51) Int. Cl.
*F21L 4/04* (2006.01)
*F21V 21/088* (2006.01)

(52) U.S. Cl. ..... 362/191; 362/198; 362/396; 248/316.4

(58) Field of Classification Search ..... 362/191, 362/190, 198, 396, 197, 199; 248/316.4, 248/316.6

See application file for complete search history.

(56) References Cited

U.S. PATENT DOCUMENTS

| | | | | |
|---|---|---|---|---|
| 4,399,498 A | | 8/1983 | Bacevius | 362/396 |
| 4,443,831 A | * | 4/1984 | Godfrey et al. | 362/190 |
| 4,495,550 A | | 1/1985 | Visciano | 362/189 |
| 4,528,622 A | * | 7/1985 | Bacevius | 362/396 |
| 4,799,132 A | | 1/1989 | Perlsweig | 362/118 |
| 4,895,329 A | | 1/1990 | Sloan | 248/229 |
| 5,103,384 A | | 4/1992 | Drohan | 362/191 |
| 5,377,087 A | | 12/1994 | Yoon | 362/275 |
| 5,584,457 A | * | 12/1996 | Fawcett | 248/229.1 |
| 5,664,875 A | | 9/1997 | Hegedus | 362/191 |
| 5,667,185 A | * | 9/1997 | Maglica | 248/316.6 |
| 5,690,416 A | * | 11/1997 | Van Gennep | 362/191 |
| 5,873,649 A | | 2/1999 | Krauer | 362/191 |
| 5,921,669 A | * | 7/1999 | Taylor et al. | 362/191 |
| 6,168,288 B1 | | 1/2001 | St. Claire | 362/184 |
| 6,290,368 B1 | | 9/2001 | Lehrer | 362/187 |
| 6,457,841 B1 | | 10/2002 | Lynch et al. | 362/199 |
| 6,488,390 B1 | * | 12/2002 | Lebens et al. | 362/231 |
| 6,540,184 B2 | | 4/2003 | Thaxton | 248/160 |
| 6,623,141 B2 | | 9/2003 | Lehrer | 362/187 |
| 6,644,827 B2 | | 11/2003 | Birdwell | 362/202 |
| 6,808,290 B2 | | 10/2004 | Lee | 362/202 |
| 6,860,622 B1 | * | 3/2005 | Rivers | 362/191 |
| 7,040,783 B1 | * | 5/2006 | Christianson | 362/396 |
| 7,090,373 B2 | * | 8/2006 | Lai | 362/190 |

* cited by examiner

*Primary Examiner*—Alan Cariaso
(74) *Attorney, Agent, or Firm*—Ladas & Parry, LLP

(57) ABSTRACT

A mobile illumination apparatus. A universal clamp for attaching to wide range objects such that a broad range of clamping abilities are achieved. Incorporating into the clamp a self-locking ratcheting mechanism for adjusting over a range of spans and fold-out fingers for applying force to the object; the clamp folds up against or into the apparatus for transport or storage. An extendable-and-retractable neck mounting for a transducing-element head thereon, for activating-deactivating the transducing-element, and moving the head to hold an orientation so as to illuminate a region-of-immediate-interest or a particular target. Drive and control circuitry to maintain the illumination intensity substantially constant.

13 Claims, 10 Drawing Sheets

PORTABLE AND MOBILE ILLUMINATION AND DETECTION

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO AN APPENDIX

Not applicable.

BACKGROUND

Technical Field

The technology described herein is related generally to the field of portable illumination and detection. More particularly, certain described exemplary embodiments relate to mobile illuminating apparatus, commonly or commercially referred to as "flashlights" and sometimes also referred to as "trouble lights." Other described exemplary embodiments relate to mobile monitoring, detecting and sensing apparatus. For the purpose of describing the present invention, it should be recognized that the words "illuminate," "illuminating," "illumination," its synonyms and the like are used both for active lighting phenomena—such as shining a white light for improving visibility—or for a more passive illumination—such as where a laser beam, infrared beam, or the like, is sometimes used for "lighting up" a predetermined target. The term "mobile illuminating device" (MID for short) is thus used generically to refer to both types of units.

One problem with most mobile illuminating devices ("MID"), e.g., a commercial flashlight, is in maintaining a beam of light directly and steadily on the immediate target-of-interest. This is particularly difficult when work being performed by a user requires both hands or is required to move around for a task-at-hand. Sometimes, a flashlight must be held by a second person, inconveniencing him or interfering with his capability to help with the task. Alternatively, the flashlight may be set on something; but, conditions may be such that it is hard to find a place to put it and still have the light beam fall on a specific work area. Moreover, the size of the work area or a particular region-of-interest of the working area may shift. This generally requires moving the flashlight to redirect the beam. Few flashlights have a variable field of illumination ("FOI") to compensate for a changing size of work area. Furthermore, commercial flashlights generally are cylindrical and tend to roll or turn, making positioning and maintaining a set position even more difficult.

Some trouble lights and portable lamps, such as "book lights," do incorporate a positioning clip or clamping accessory. These accessories usually only clip to very restricted type of mount or perhaps to the user's clothing. Similar to the latter, another alternative is a device known as a "headlamp," where the lamp is attached to a helmet or a headband. A user's head-mounted unit is fairly specialized and not universally used for mobile illumination. The user must continually aim the light into the region they are working by pointing their head in that direction. Headlamps may be considered cumbersome or uncomfortable. If more than one person is working in the area but only one has a headlamp, problems are compounded as that one's head may need to be moved or turned for various reasons.

Another common approach with a smaller flashlight is to hold it in one's teeth and aim it at the work area. This action is less than satisfactory. Aiming the lightbeam has the same problems as with headlamps. Moreover, dental damage may result; contamination of the mouth by dirt on the flashlight can occur. This approach is at best also only a short term solution as one's mouth muscles easily tire.

Another problem is that many flashlights, trouble lights, headlamps, and the like, use incandescent bulbs whose filaments are fragile when they heat up. When bumped they often burn out. Often the lens or bell jar bulb cover becomes hot enough to burn skin. Yet another common problem with these models is that they are often used in working on vehicles. Once the user finally is positioned in a difficult place—e.g., under the vehicle—and has positioned the light, they either burn themselves on the hot incandescent bulb or bump it in repositioning themselves and redirect the beam or even blow out the bulb. The user then must withdraw from the difficult working position for treatment or to replace the bulb. Further, incandescent bulbs have a relatively low efficiency in conversion of electricity to light and a relatively short lifespan. Battery-operated, incandescent bulb apparatus are subject to a fading light intensity as the batteries are depleted and must be replaced or recharged.

Rechargeable devices often use specialized batteries, require removing the batteries and charging elsewhere, and may require special charging voltages and specifically designed chargers. Rechargeable flashlights may require recharging only in a selective manner, selective locations, and with selective equipment which must be maintained in a proximity for repeated usage.

The best illumination for human visibility generally is white light. Incandescent lights have a high yellow component of color and as battery output voltages deteriorate, the light becomes even more yellow. They therefore are not optimum for many required uses, particularly prolonged uses. In some cases, illumination with red light, ultraviolet light, or even infrared light is desired. Infrared and red light for example are desired in many military situations. Flashing red or even blue lights are often used in warning situations.

Similarly, mobile detectors or sensors—such a motion detectors, heat detectors, and the like—suffer from like or similar problems as described hereinabove with respect to visible light projection.

There is a need for improved solutions for these problems.

BRIEF SUMMARY

The present invention generally provides for a self-contained mobile illumination apparatus, providing easy operational considerations including, but not limited to, user-variable mounting abilities, ease of headpiece directability, and a relatively longer operational duty cycle. Various exemplary embodiments are described.

The foregoing summary is not intended to be inclusive of all aspects, objects, advantages and features of the present invention nor should any limitation on the scope of the invention be implied therefrom. This Brief Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches.

BRIEF DESCRIPTION OF THE DRAWINGS

FIGS. 3A through 3C are schematic illustrations of a more detailed exemplary embodiment of the invention as shown in FIG. 1, in which:

FIG. 3A includes a relative top view in partial cutaway and an orthogonal projection end view thereof, FIG. 3B includes a relative side elevation view in partial cutaway and an orthogonal projection external end view thereof, and FIG. 3C includes the side elevation view as shown in FIG. 3B in an altered operational state, an orthogonal projection internal end view thereof (left side), and an orthogonal projection external end view thereof (right side).

Like reference designations represent like features throughout the drawings. The drawings in this specification should be understood as not being drawn to scale unless specifically annotated as such.

DETAILED DESCRIPTION

Mobile Illumination Device Exemplary Embodiments

Figure 2:
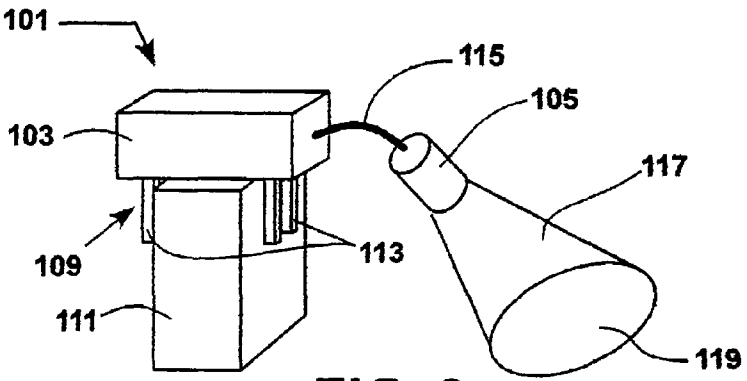
FIG. 2 is a schematic diagram of the embodiment of FIG. 1 demonstrating an exemplary in-use configuration.
Figure 1:
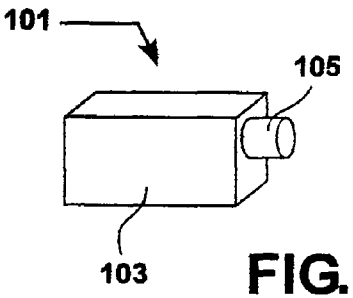
FIG. 1 is a schematic diagram of a first exemplary embodiment of the present invention, demonstrating a closed or stored configuration.

Looking now to both FIGS. 1 and 2, an exemplary embodiment for a portable, mobile illumination device ("MID") 101 is disclosed, having several unique features. A handheld size implementation is shown, but it should be recognized that size is not a limitation of the present invention. It will be recognized by those skilled in the art that actual size and external shape of the MID body 103 may be implemented to suit a variety of needs and ultimate functions. In FIG. 1, the MID 101 is illustrated in its carrying or storage configuration when not in active use. An MID body 103 may serve also as a handle. Internal electronics (not shown; see later drawings) with an illumination headpiece subsystem 105 (also referred to more simply hereinafter as "the head 105") are depicted in a configuration with a transducer, and known manner lens if required, 107 protruding, at least partially, from the body 103. In a preferred flashlight-like embodiment, white light emitting diode ("LED(s)") elements are used as transducers.

FIG. 2 illustrates the MID 101 of FIG. 1. in operation. The MID 101 is provided with a substantially universal clamp subsystem 109 to be described in more detail hereinafter. The clamping subsystem 109 includes projections 113 which may be selectively extended from the body 103 and retracted into the body 103. The clamping subsystem 109 is configured for allowing the MID 101 to be clamped tightly; namely to be substantially locked onto an object to such an extent that bumping or the like will not alter the orientation of the MID 101. Moreover, the clamping subsystem 109 is constructed to lock onto a relatively large variety of objects 111, regardless of an individual object's shape and size within a given variable clamping span defined by specific design implementation. In other words, the clamping subsystem 109 may lock onto an object whether it is generally rectangular and flat surfaced as shown (e.g. two-by-four beams, shelves, tables, or projections from doors, windows, building structures, vehicles, or the like) or a circular-shaped surface (e.g., pipes, electrical conduits, hoses, and the like) as well as small odd-shaped objects (e.g., hose nozzles, bent rods, handles of devices, or smaller subparts of building structures or vehicles (e.g., a car fender)). In general, this substantially universal clamping feature is achieved by incorporating a ratcheting-type subsystem to quickly adjust and clamp over a relatively wide range, in general dictated only by the size of the body 103 and the reach and variable span of individual fingers 113 of the clamping mechanism 109.

Figure 2A:
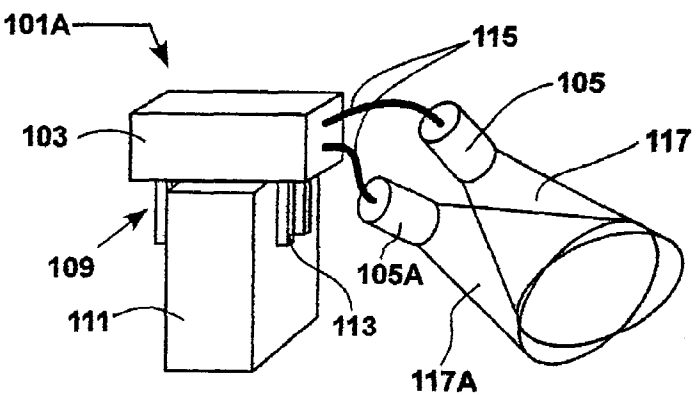
FIG. 2A is an illustration of the embodiment of FIG. 1A in operation.
Figure 1A:
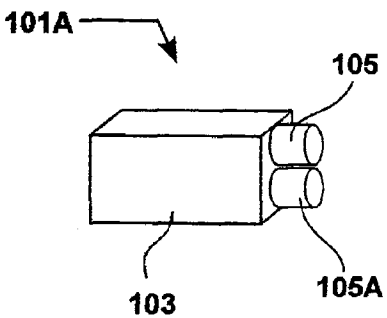
FIG. 1A is a schematic diagram of a second exemplary embodiment of the present invention, demonstrating a closed or stored configuration.
Figure 2B:
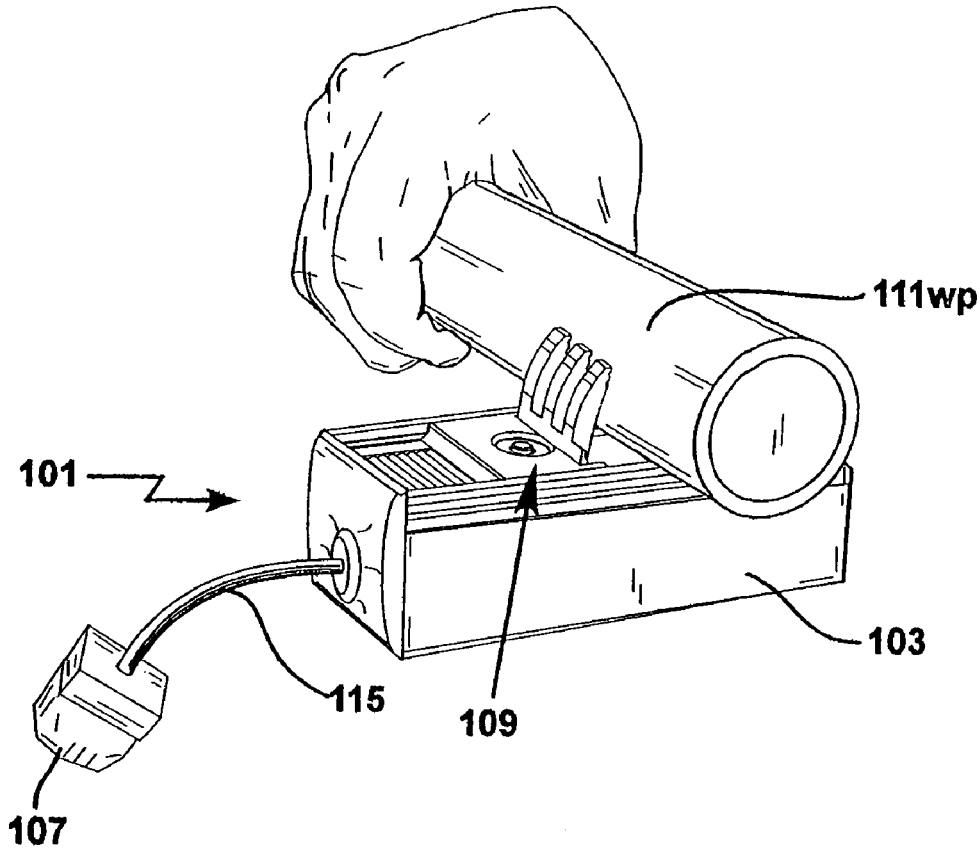
FIG. 2B is an illustration of another exemplary embodiment, similar to that of FIG. 1 in operation.

FIGS. 1A and 2A illustrate another exemplary embodiment of an MID 101A wherein a plurality of illumination heads 105, 105A is provided. FIG. 2B illustrates an industrial application wherein a handheld sized exemplary embodiment of the MID 101 is shown gripping a common piece of PVC pipe such as commonly used as a waterline 111*wp*.

The MID 101 has an extendible, energy transducer support 115. For example and as shown, the support 115 may have an extendible, flexible neck portion, sometimes referred to in the art as a "gooseneck," onto which the illumination headpiece 105, or at least some components thereof, may be mounted on an external end thereof so that the headpiece may be pulled outwardly from the body 103. This allows the illuminator components of the headpiece 105 to be positioned for selectively aiming projected light beam 117 and illuminating a relatively specific target such as a working-area-of-interest 119. Extraction and retraction of the neck-and-head subassembly may be manual, mechanically enhanced (e.g., known manner spring-loading or the like) or driven (e.g., via electrical motor-transmission subsystems or the like). It now can be recognized that this flexible energy transducer support 115 as well as the clamping fingers 113 fold conveniently back into the MID body 103 when the MID 101 is not in use, thus also making it easy to carry the MID without accidentally damaging them or having them snag on pockets or other carrying container parts (e.g., a belt pouch, not shown). The flexing of the exemplary gooseneck 115 should be rigid enough to support the head 105 and hold it aimed at a desired point. It however also should be flexible enough to be easily repositioned without disengaging the clamping mechanism 109 from the supporting object 111. It can be recognized by those skilled in the art, that alternatively a relatively rigid energy transducer support 115 and a known manner universal swivel mount of the illumination head 105 may be implemented alternatively. Thus, once clamped in a location proximate to a work region-of-interest to be illuminated with the MID 101, the adaptable head-and-neck construct may be pulled out and positioned and aimed at the working region-of-interest to be illuminated, freeing the user's hands. Note that with this adaptable configuration neck-and-head construct, the region may lie in more than a hemisphere space distal from and along the main axis of the MID 101 unit. In small units, the neck-and-head design may be such that the head-piece 105 may be positioned to shine in any direction of a spherical construct having the MID 101 at the general center of the sphere. Also alternatively, energy transducer support 115 may be of a type that has a telescoping capability.

In a preferred embodiment of a flashlight type implementation, the MID 101 uses light emitting diode ("LED") components because in accordance with the current state-of-the-art to provide durability and long operating life, high electrical-to-illumination conversion efficiency, provide a purer white light for better illumination in contrast to the yellow light of incandescent bulbs, and are available in other colors LED's for special illumination requirements (e.g., red for photographic darkrooms, ultraviolet for gemology studies, or the like).

In addition as described in more detail and shown in later drawings, circuitry is incorporated into the MID 101 to hold the illumination light at the same intensity even as portable electrical supply voltage, viz., battery output, deteriorates. In general, in the preferred embodiment the MID 101 employs commonly available batteries which may be either rechargeable or non-rechargeable. For the latter, known manner recharging mechanisms are incorporated which preferably allow charging from common sources such as 115 volt, 60 Hz AC or 12 volt DC sources.

Figure 3A:
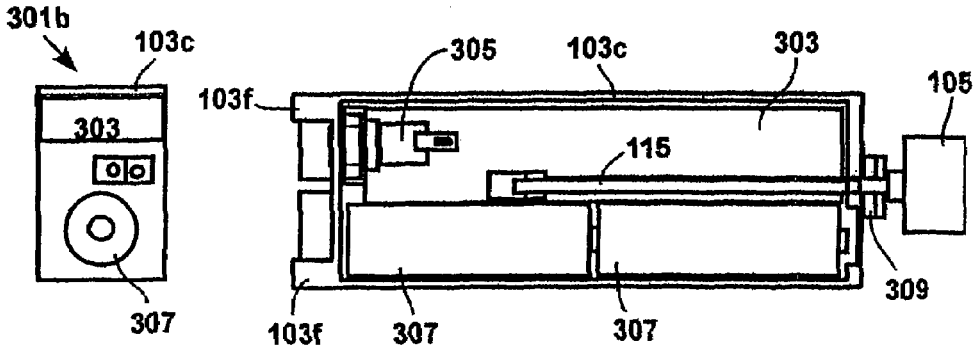
Figure 8:
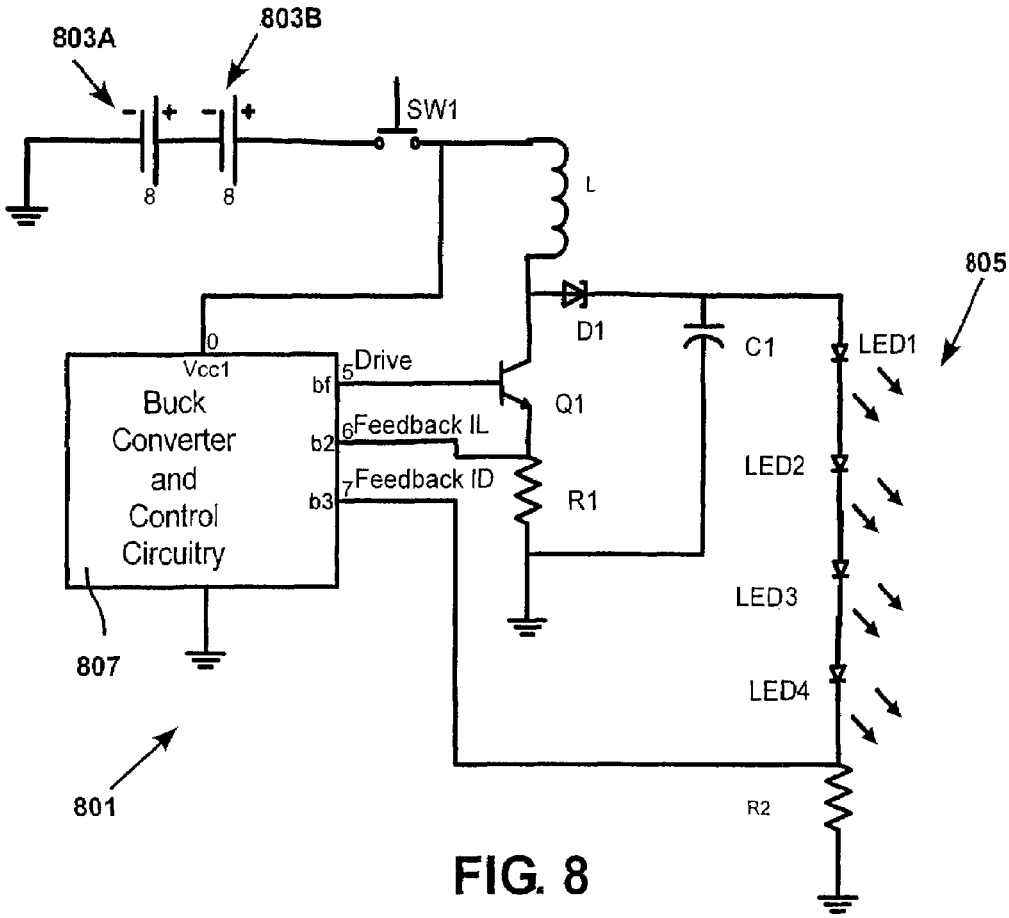
FIG. 8 is an electrical schematic drawing of an exemplary embodiment of LED driver circuit providing battery depletion compensation in accordance with an aspect of the present invention.

Turning now to FIG. 3A, a cutaway, relative top view (in section B—B, see FIG. 3B orthogonal end projection) and an end view orthogonal projection thereof, schematically illustrate both external and internal and internal features and component relationships in accordance with an exemplary embodiment of the present invention as depicted in FIGS. 1 and 2. The MID body 103 has a casing, or shell, 103*c* with interior compartments. As shown in the top view, on the left end of the case 103 there may be four stand-off feet 103*f* (two visible) protruding in a manner which promotes standing the unit on its end, specifically advantageous if the case 103*c* is designed to be cylindrical. In the end view, a relative bottom compartment 301*b* contains a printed circuit board 303 and electrical components thereof (not shown, but see also FIGS. 8A, 8B). An optional, known manner recharging connector subsystem 305 and related known manner charging-electronics (not shown), associated with optional, rechargeable batteries 307, may be employed. It will be recognized that a commercial disposable battery type(s) may be employed in accordance with a specific implementation as needed.

As per FIG. 2, the illumination head 105 is mounted onto one end of the energy transducer support 115. For some implementations, it may be desirable to make the MID 101 moisture resistant. For example, an optional grommet 309 and other known manner elements (e.g., rubber gaskets, O-rings, bellows couplings for the case 103 and head 105, and the like) may be employed. A conformal covering—such as a tight sheath may be used (for example formed from shrink tubing)—to seal the support 115 itself from moisture or other contaminants may also be employed. A variety of known manner sealing methods may be used for the head 105 where the support 115 attaches to it, such as a rubberized sealant or the like.

Figure 3B:
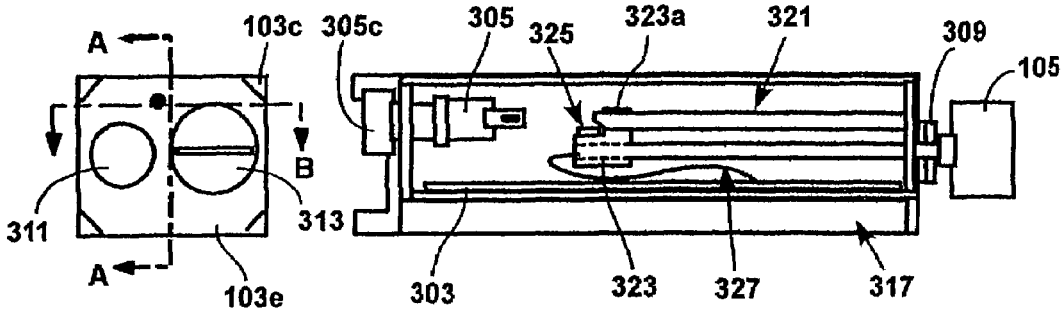
Figure 3C:
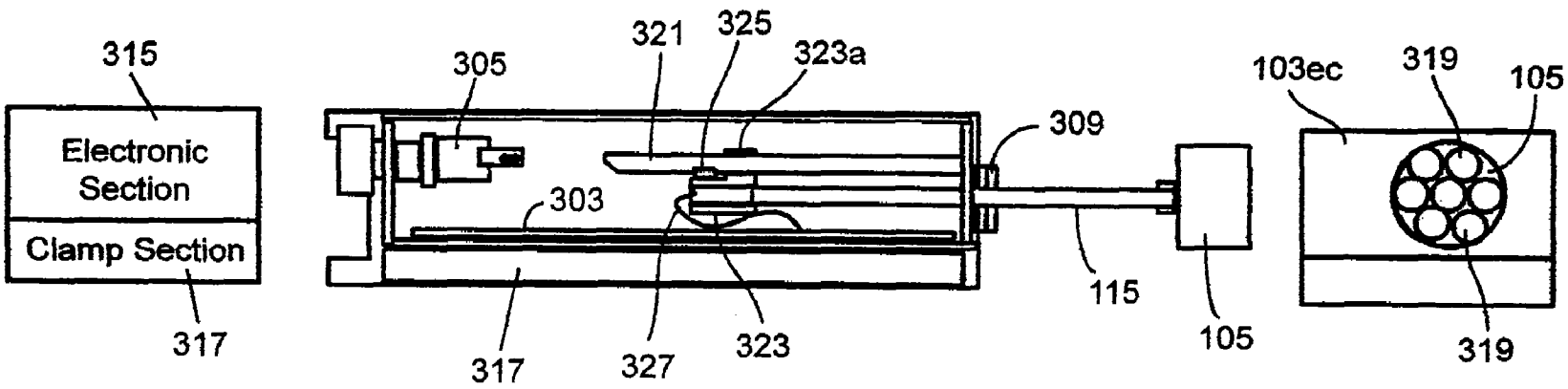

Looking now also to FIG. 3B a cutaway, side elevation view and relative left orthogonal projection thereof illustrates both orientation and partial operational features of the exemplary embodiment of FIGS. 1, 2 and 3A. The end view in FIG. 3B depicts a case end piece 103*e*; also showing the section A-A designation for the side elevation view. In this embodiment, the case end piece 103*e* includes an openable, or removable, recharging connector cap 311 and an openable, or removable, battery cap 313. The side elevation view of FIG. 3B is taken in section A-A of said end view. FIG. 3C left end view projection depicts the compartment segregation of the MID 101 into an "Electronics Section" 315 and a clamping subsystem "Clamp Section" 317. It can be recognized that the batteries 307 have been deleted from the sectioned, side views of FIGS. 3B and 3C but would generally be included in or proximate the Electronics Section 315. FIG. 3C right end view projection depicts for the first time an LED element 319, in this exemplary embodiment an array of LED elements, used to create the light beam 117, FIG. 1 only. As is known in the art, the amount of light output by an LED head 105 is proportional to the number of LEDs 319 used as well as the level of current excitation applied and which they can tolerate. In this exemplary embodiment, multiple LEDs 319 may be assembled into an array so they touch and are held adjacent to each other; while seven LEDs are shown in this configuration, a greater or lesser amount also could be used. For projector-type MID 101 apparatus other state-of-the-art projecting elements, e.g., fiber-optical bundles, or the like, may be employed and particularly useful in miniaturized versions of the MID which may be clamped to a medical operating instrument, or the like delicate-purposed instruments.

In this exemplary embodiment, a substantially rigid guide-and-activation rod 321 may be fixedly mounted within the Electronic Section 315. The rod 321 is in near proximity to the energy transducer support 115 and is approximately the same length, but slightly shorter in this embodiment for reasons to be explained. The rod 321 also may provide mechanical strength and force to restrain the support 115 and head 105 assembly from twisting while being extracted-retracted or once retracted. Distally from the head mount end of the energy transducer support 115, there may be mounted to the neck a guide-and-switch block 323. The guide-and-switch block 323 slidingly engages the guide-and-activation rod 321, such as via a coupling arm 323. A microswitch 325 which may be used to turn the LED, or array, 319 between ON and OFF conditions is also mounted to the guide-and-switch block 323. As can be seen by comparing FIG. 3B, where the energy transducer support 115 is fully retracted into the MID case 103*c*, and FIG. 3C where the neck is partially extended from the case, the guide-and-activation rod 321 is positioned to respectively electrically disengage and engage the micro-switch 325 such that power is delivered from the batteries 307, FIG. 3A, via the components of the printed circuit board 303 and flexible electrical wiring 327 to the LED array 119. Alternatively, known manner tongue-and-groove type sliding electrical connectors or the like may be used to engage and electrically interconnect the LED array 319 with the electronics of the printed circuit board 303. Another alternative to the use of a rod for guiding the travel of the switch block and preventing rotation is to include channels or guides actually built into an interior case wall so as to restrict the movement of the switch to a specific orientation and travel.

Figure 4A:
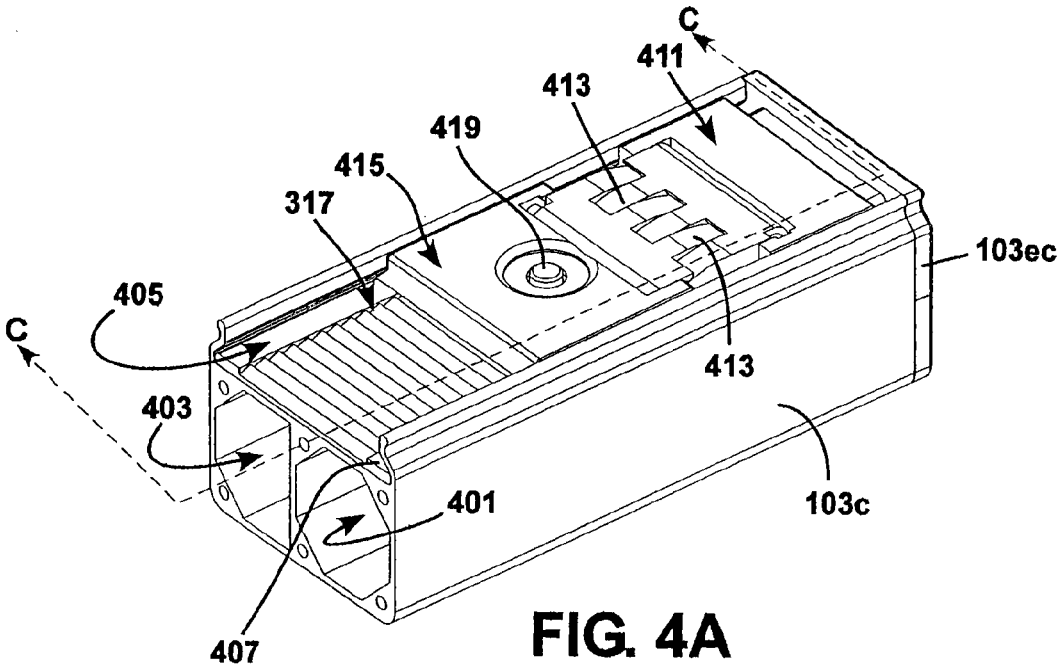
FIGS. 4A and 4B are related views in a relative longitudinal perspective of another exemplary embodiment, demonstrating specific components and highlighting a universal clamping subsystem thereof.
Figure 4B:
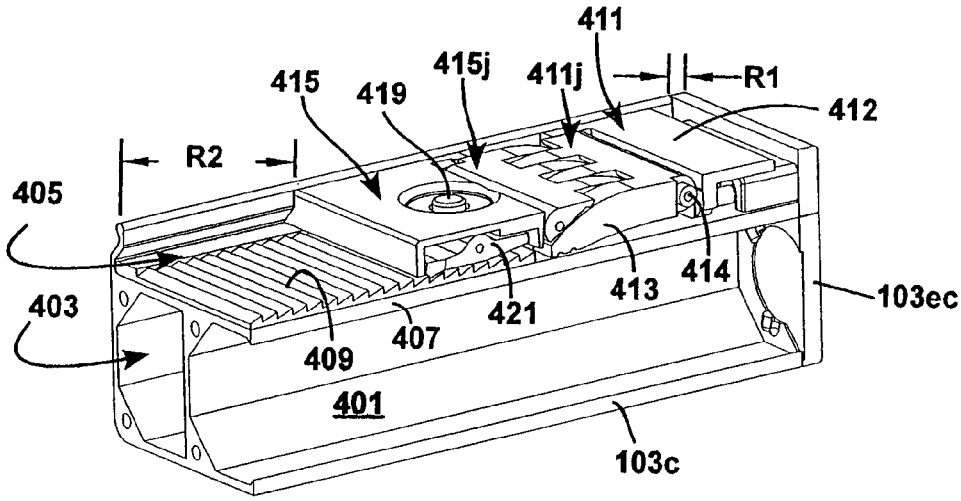

FIGS. 4A and 4B are related views in a longitudinal perspective of an exemplary embodiment 401 of specific components of the present invention, highlighting a universal clamping subsystem thereof. In FIG. 4A, housing case 103*c* is shown with an end cap removed. FIG. 4B comprises Section C-C of FIG. 4A. Both illustrate an internal cavity 401 for the battery or batteries (not shown, see FIG. 3A) and another internal cavity 403 for the electrical and electro-mechanical components (not shown, see FIGS. 3A, 8A, 8B) of the apparatus. The clamping section 317 is now shown in detail in both FIGS. In FIG. 4B, a section of a distal one end cap 103*ec* is shown which holds the clamping subsystem 317 components in place on one side thereof with some special features explained later.

Figure 5A:
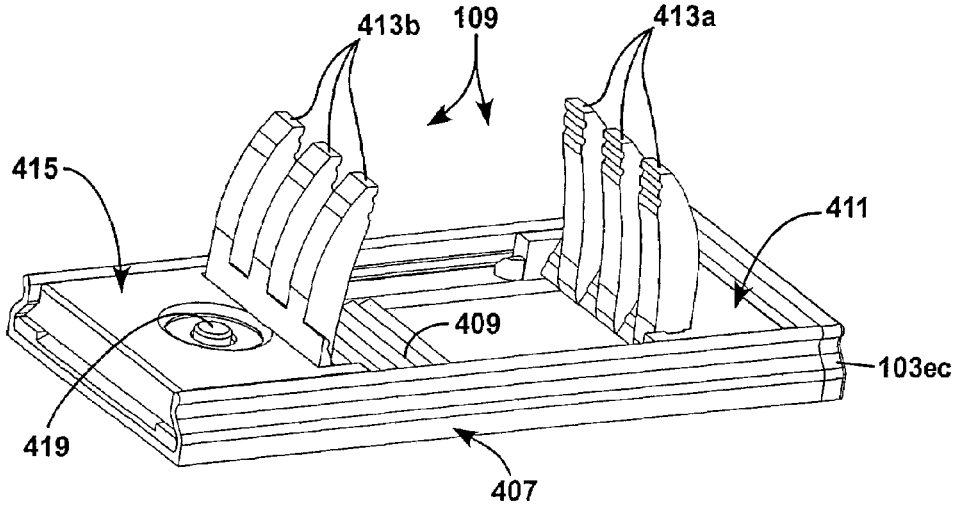
FIGS. 5A and 5B are related schematic perspective view of details of the exemplarily embodiment of FIGS. 4A, 4B, illustrating clamping components with clamping jaws open to a position to engage and clamp onto a relatively wide object and a position to engage and clamp onto a relatively narrow object, respectively.
Figure 5B:
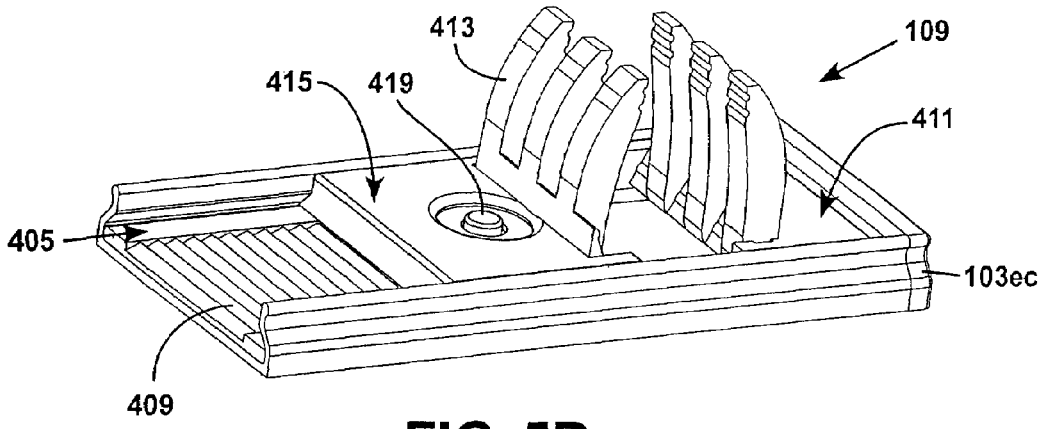

In this exemplary embodiment, the main body of the housing case 103*c* may consist of an extrusion consisting of a battery compartment 401, electro-mechanical components compartment 403, and a clamp holding guide 405. The clamping subsystem 109 includes a clamp base 407, having a sawtooth ratcheting planar surface region 409. In these views, the clamping subsystem is shown in a jaws closed, or stored, configuration. Briefly looking to FIGS. 5A and 5B, there is respectively illustrated clamping components with the jaws of the clamping subsystem 109 open and moved along the sawtooth ratcheting plane to a position to engage and clamp a relatively wide object and a position to engage and clamp a relatively narrow object. A first mount assembly 411 has preferably a plurality of, but at least one, extendable fingers, or protrusions, 413*a*. Once released from the jaws closed configuration of FIGS. 4A, 4B, these fingers 413*a* may be on a pivot mechanism, such as an axle or pivot rod, 414 and may be moved, or be spring-loaded to automatically extend, substantially perpendicularly from the guide 405, and hence also with respect to the case 103*c* as shown in FIGS. 5A, 5B. A second mount assembly 415 may be slidingly mounted in the guide 405 and, similarly to first mount assembly 411, may have a set of extending fingers 413*b*. The two sets of fingers 413*a*, 413*b* form substantially parallel plane jaw teeth which are used to clamp the MID 103 to an external object 111 as shown in FIG. 2. Note that while shown have a substantially identical reach in the exemplary embodiments, projecting fingers with un-identical reach may be employed. Finger shape may be adapted to specific purposes.

Both the first and second mount assemblies 411, 415 (also more simply referred to hereinafter as "mount" or "mounts") generally are held laterally in place by the clamp holding guide 405. As seen in these illustrations, the first and second mounts 411, 415 are substantially co-planer in freedom-of-motion along the longitudinal axis of the guide 405. However, the first mount 411 has only a limited range of motion, "R1" (FIG. 4B) and is biased to the casing end cap 103*ec* via, for example, a compression spring, or springs, 417 which apply compression force against the first mount 411 to push it away from the end cap 103*ec* and toward the second mount 415. A push button 419 when depressed allows the closed jaws with extendable fingers interlocked (FIGS. 4A, 4B) to be opened by sliding the second mount 415 movable jaw section 415*j* longitudinally along the guide 405 away from the first mount 411 (FIGS. 5A & B). The second mount 415 is shown to have a larger range of motion, "R2" (FIG. 4B) relative to R1. The exact span of these ranges of motion R1, R2 may be determined by the size of the guide 405 as dictated by the size of a specific implementation of the unit's case 103.

Figure 6A:
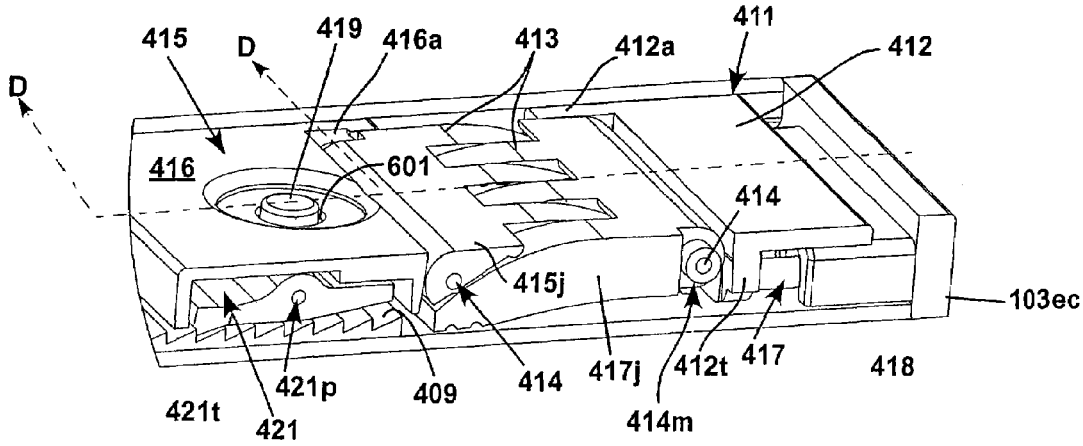
FIGS. 6A and 6B are detail views of the exemplary embodiment of FIGS. 5A, 5B, where 6B is a detail of 6A.

A substantially automatic clamp locking mechanism is formed by a having a pawl mechanism 421 integrated with the second mount 415 and interfaced with the sawtooth ratcheting planar surface region 409 of the guide 405. FIG. 6A is a closer, elevation view of details from FIGS. 4A-5B for clamping jaws, pawl mechanism, and ratchet-locking mechanism, and their respective operation. Note from FIG. 6A, that for this exemplary embodiment, the protruding tip of each jaw finger 413 is wedged underneath each jaw pivot 414, 414' of the opposing mount's jaw; thus in a torsional-spring (not seen) spring-loaded jaw implementation, the jaws are latching each other in a closed configuration as shown.

At the left of this view, the second mount 415 is shown consisting of a cover body 416, subjacent locking pawl 421 mounted on a pivot mechanism, such as an axle or pivot rod, 421*p*, locking pawl release button 419, and pivot 414' mounted jaw section 415*j* with three extendable fingers 413. At the right of this view, the end cap 103*ec* may be provided with a spring holding shoe 418. This shoe 418 holds compression springs 417 (one exemplified) in guide 405 longitudinal alignment. Slightly to the left of the shoe 418, the first mount 411 consists of a cover body 412, a jaw section 411*j*, opposing the second mount 415 with three fingers 413 mounted on a pivot 414 similar to spring-loaded pivot 414'. Descending tabs 412*t* on each side of the body 412 may be provided for slipping into each respective compression spring 417 to further maintain longitudinal alignment thereof. Horizontal arms 412*a* (one on each axial side) may be configured for holding the pivot 414' (the arm on the viewer's side has been cut away). The pivot rods 414, 414' pass through each respective jaw section 411*j*, 415*j* and into each respective arm 412*a*, 416*a* providing rotational support for the jaw. Further, each jaw section 411*j*, 415*j* may have a hub, or mandrel, 414*m* on at least one side (the viewer's side for the first mount 411) where a torsion spring (not shown) may be wound for spring-loading the jaws 411*j*, 415*j*; opposite ends of the torsion spring respectively engage the cover body 412, 416 and related jaws. Preferably, the spring may be wound so the rotational force is in the direction to open the jaws 411*j*, 415*j*, but snap-shut bias may be useful in particular implementations where detaching speed is a critical consideration (e.g., military uses).

Looking also now at FIG. 6B, a detail of FIG. 6A, section D-D, the sawtooth ratcheting planar surface region 409 (for convenience also referred to more simply hereinafter as the "ramped track 409") interfaces with the pawl mechanism 421 for locking the jaws 415*j*, 411*j* about surfaces of an external object, e.g., 111, FIG. 1 or 111*wp* of FIG. 2B. The second mount 415 cover body 416 has an aperture, hole, 601 for the locking pawl release button 419 to pass through and apertures, holes, (not seen) on the lateral sides thereof to accept and support the pivot 421*p* for the locking pawl 421. It can now be seen how the locking pawl 421 operates and allows the second mount assembly 415 to be ratcheted into in place and released. Simultaneous reference to FIGS. 5A and 5B will be helpful in understanding this operation.

The locking pawl 421 is shown in FIG. 6A with its holding tooth 421*t* engaged into the ramped track 409. As seen in FIG. 6B, a pawl bias, such as a leaf or coil spring, 603 between the upper surface 421*s* of the pawl 421 and the lower surface 416*s* of the second mount 415 body 416, forces the pawl toward the ramped track 409. The pawl pivot axle 421*p* allows it to easily rotate to this position. Note that in FIG. 6A the button 419 is not in a depressed state. When the locking pawl 421 is thus engaged, a force applied to the left on the second mount assembly 415 is resisted by the vertical region of the sawtooth, keeping the pawl and the jaw 415*j* from further moving to the left. However, a force—such as applied by the user—applied toward the right would allow the second mount assembly 415 to move freely to the right as the locking pawl tooth 421*t* would move up the ramp. When the pawl 421 reaches the next sawtooth excursion, it would be forced by the bias 603 into a position as shown in FIG. 6A except it would be one sawtooth step to the right. A continued force to the right on the second mount assembly 415, when meeting no restraining counter-force, would allow the assembly to continue to move to the right, locking at each step in this manner. However, when a restraining counter-force is met—for example from the object being clamped; see e.g., 111, FIG. 2—that exceeds the applied force to the right, second mount assembly 415 will be stopped from further movement to the right. While the second mount assembly 415 may move back to the left when the force to the right is diminished even slightly, the first vertical region of the sawtooth it is on will stop further motion to the left. At that point the pawl 421 will be fully engaged and will hold its position and the restraining force is applied to the object. This overall action forms the ratcheting method of clamping the jaws 411*j*, 415*j* tightly to an object 111.

Figure 6B:
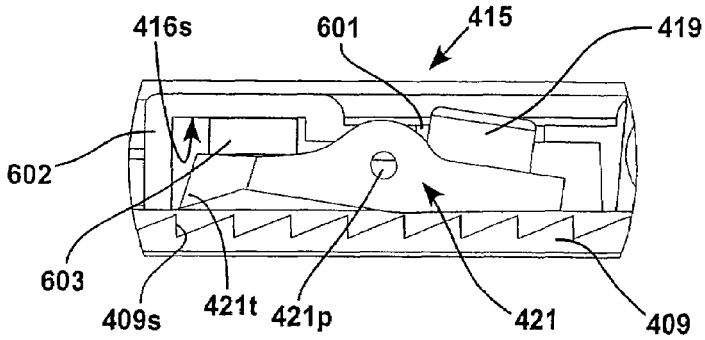

FIG. 6B also illustrates the method of releasing the jaws 411*j*, 415*j*. Depressing the release button 419 causes the pawl 421 to rotate around its pivot 421*p*, lifting the tooth 421*t* clear from the relative engaged surface 409*s* of ramped track 409. Once lifted free, with the button 419 depressed the second mount assembly 415 can be slid to the left by the user, thereby releasing the clamping forces on the object 111. If there is no further current need for the MID 101, the jaws 411*j* and 415*j* may be moved to the closed or storage position and re-interlocked as described with respect to FIG. 6A hereinbefore.

Figure 7A:
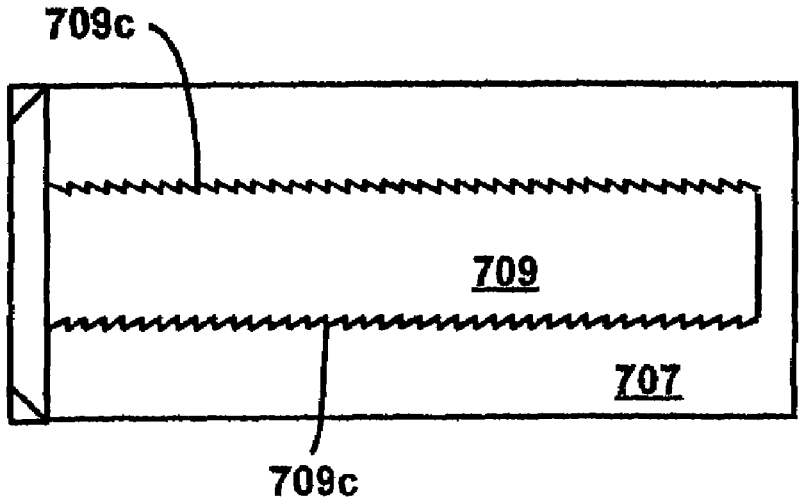
FIGS. 7A and 7B are related plan views of an alternative exemplary embodiment of clamp mechanism features of the present invention as shown in FIG. 2.
Figure 7B:
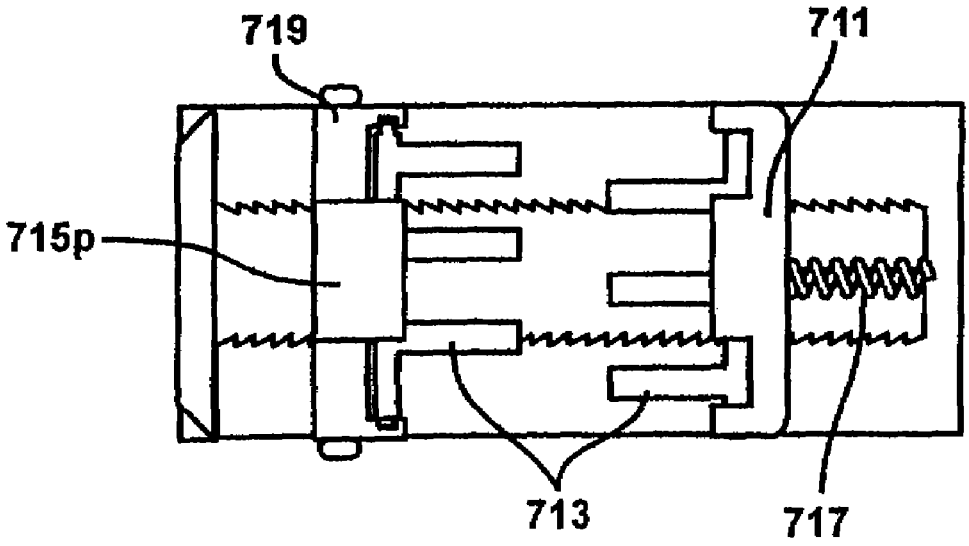

To illustrate that the clamping mechanism is not intended to be limited to the configuration of the above-described embodiment, an alternative exemplary embodiment is shown in FIGS. 7A and 7B. It will be recognized by those skilled in the art that the operation is substantially the same. However, in this embodiment as shown in both FIGURES, the guide surface 707 (compare e.g., surface 407) has a sawtooth raised region 709 (compare e.g., ramp track 409) wherein the catch surfaces 709*c* lie in the same relative horizontal plane as the guide 707 surface. Looking now at FIG. 7B, a biased 717 jaw apparatus 711 (comparable to element 411) and a movable jaw apparatus 715 (comparable to element 415), each have clamping fingers 713 (see also element 413). A relatively horizontally-acting, biased-to-automatically-lock, pawl mechanism 715*p* interfaces the movable jaw apparatus 715 in a manner analogous to that described previously with respect to FIGS. 6A and 6B. A difference is that a pawl lock-release button 719 now also operates in a relative horizontal fashion to allow free motion, left-right in the drawing orientation. Still other arrangements can be employed to create a clamp with a broad clamping range. For example, instead or sawtooth grooves a series of circular indentation may be used and they may be imposed into side or orthogonal to the base of the unit. The locking and release mechanism would be designed to have a plunger or pawl tip to engage these indentations. The clamp jaw would be adjusted by depressing the release and moving it along to some point then letting go of the release mechanism. At that point the locking would engage the circular indentation and be held there. Thus, without belaboring the point, it will be recognized that many such implementations may be designed yet still be within the scope of the present invention as claimed.

To summarize one exemplary embodiment and operation thereof, one finger assembly allows grasping the object on one side and a second finger assembly grasps the object on the other side. In the simplest embodiment, one finger assembly uses a spring to push the assembly along the base of the unit and apply force against the object. The second finger assembly utilizes a ratchet mechanism for moving the assembly along the base of the unit and applying the force against the object. The ratchet is composed a series of indentations in the base of the unit and mechanism to lock the fingers to a position along the indentation as well as a release mechanism for moving the fingers to a relaxed position. The series of indentations consist in one embodiment of saw tooth type of steps promoting automatic detenting action as when the clamp finger assembly is pushed towards a clamping or compression position. A release control allows the finger assembly to be backed away from a compression position. Another embodiment allows the finger assembly to freely move along the indentations but be locked at particular position by a detenting mechanism activated by the user. Releasing the locked position requires the user to deactivate the detenting mechanism.

Thus in operation, an object is clamped by depressing the push button release and initially advancing the movable jaw to encounter one side of the object while the biased, limited movement section encounters the other side of the object. The jaws are clamped tightly to the object by continuing to advance the movable jaw against the object but with out depressing the release button. This action will allow the movable jaw to ratchet, sawtooth-by-sawtooth, along the ratcheting plane, pushing against the object. The object then pushes against the limited movement jaw compressing the bias thereof. This total action increases the clamping force of both jaws against the object each time the movable jaw is advanced a ratchet step. At some point the force is increased to a degree where the clamp is tightly held on to the object. To disengage the clamp, the push button release is depressed and the movable section is slid back. The jaws when closed, such as shown in FIGS. 4A, 4B and 6A, provide a low profile for transporting the illumination device. When opening the clamping assembly for attaching to an object, the jaws pivotally open automatically by means of spring compression once the movable section is retracted enough for the tip of the fingers of the jaws to disengage from their opposing base of the opposite jaw. To close the jaws, the finger tips must be manually forced closed and the movable section advanced to the position shown in FIG. 4A where the finger tips once again engage the opposing base of the opposite jaw and are held closed by them.

Mid Drive Circuitry

Figure 8A:
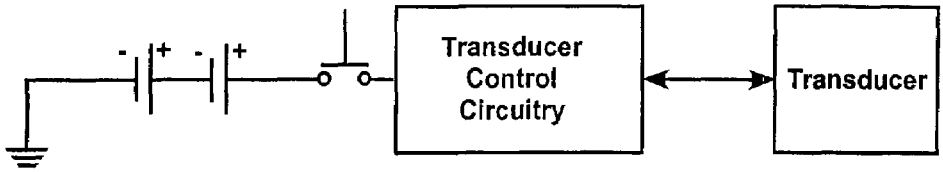
FIG. 8A (Prior Art) is an electrical schematic drawing of an exemplary embodiment of a emitter-detector driver circuit adaptable for use with the present invention.

Another feature of the exemplary embodiments of the present invention is the drive circuitry. In the preferred embodiment, drive and control circuitry provides for the preferred mode of excitation of the illumination device and compensates for deteriorating battery voltage in order to maintain illumination intensity substantially constant until the battery is substantially depleted. FIG. 8A is a circuit schematic for an exemplary embodiment LED driver circuit 801. Two batteries 803A, 803B are shown connected in series to produce a predetermined electrical voltage related to driving the LED1-LED4 array 805. If for example each battery consists of a single cell alkaline battery, the nominal voltage of each is 1.5 volts; or for example if single cell rechargeable NiMH type battery, the nominal voltage is 1.2 volts at full charge. Assume the LED array 805 requires about 3.65 volts each for them to be turned ON completely. Therefore circuitry 801 is required to step the voltage up; a known manner Buck Converter and Control Circuitry 807 is used to do this. The converter uses the circuitry in the Buck Converter and Control Circuitry to drive ("Drive" signal line) transistor Q1 in and out of saturation. When Q1 is switched ON to a saturation mode, current flows from the batteries 803A, 803B through the inductor L. After Q1 switches ON, the current linearly rises with time through the inductor L. The current flows through Q1 and first resistor R1. When the current reaches a level predetermined by the resistance of R1, the voltage rises across it to the point where predetermined Feedback ID signal reaches a level to signal the Buck Converter and Control Circuitry 807 to shut off the drive to Q1. When this happens since, the inductor L seeks to preserve current flow, the voltage at the collector of Q1 jumps to a level where diode D1 begins conducting, passing current to the capacitor C1 and the string of LEDs. For example, if four LEDs are used as shown, this voltage level is approximately four times 3.65 volts. The Buck Converter and Control Circuitry 807 allows this action to occur for a time designed to allow most of the energy to be removed from the inductor L; then, Q1 is switched ON again by the Drive signal, causing a repeat of the cycle. The duration of the cycle is set in part by the value of L and the value of R1 as well as the Feedback ID signal trip point voltage. The capacitor C1 provides a smoothing action to store extra charge when D1 is conducting and delivering it to the LEDs when it is not.

LEDs perform most safely when the current flowing through them is controlled to be a fixed value independent of their temperature and voltage drop across them. Thus, in order to compensate for battery power depletion, the circuitry 801 accomplishes this by using the voltage that develops across an added resistor R2 as the feedback (Feedback ID signal) to the Buck Converter and Control Circuitry 807. This feedback voltage, if less than some preset value (a trip point) allows the Buck Converter portion to continue to cycle until the voltage across R2 rises above this trip point. It then stops the Buck Converter cycling until the voltage drops below the trip point and then it restarts the cycling action. In this manner charge is built up on C1 and is discharged at a fairly constant rate through the LEDs. The current level is set by choosing the value of R2 such that at the desired current the voltage across is equal to trip point level.

Locating the R2 in the light head or LED display head allows using different types—e.g., colors—of LEDs. For example, if a LED type is selected for the display head that requires less current than an alternative LED type, the head is designed with a higher value R2 used in the head to properly control the current level. Interchangeable heads may be used by incorporating the proper R2 value into each head assembly and by having a three lead contact arrangement in the head receiving section. The three leads would provide connections for the positive LED excitation, the return to ground, and a connection from R2 to the feedback loop of the control circuitry.

The illumination from the head may have a wide, medium, or narrow beam 119, FIG. 2. Each beam width may be optimized for a special purpose. For example, a narrow beam produced by a laser diode might be incorporated for the purpose of aiming the head at a specific target. The spectrum of the emitted light maybe mostly be of a single color or be composed of multicolors and the colors may be in the visible or non-visible region of the spectrum. For example, in military use, red illumination might be used to preserve the night vision of the user or infrared to avoid visible detection by others. Alternatively, white light may be used to provide the best visible illumination.

Mobile Monitoring Embodiments

Figure 9A:
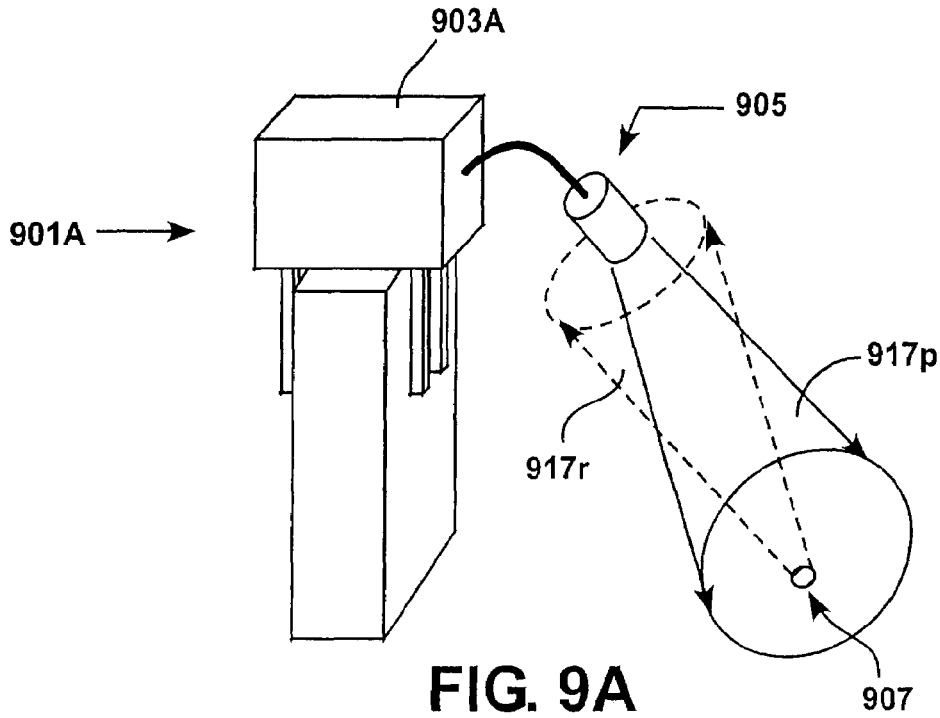
FIGS. 9A and 9B are related perspective views of schematic representations of another alternative exemplary embodiment of the present invention in which an emitter-detector head is employed.
Figure 9B:
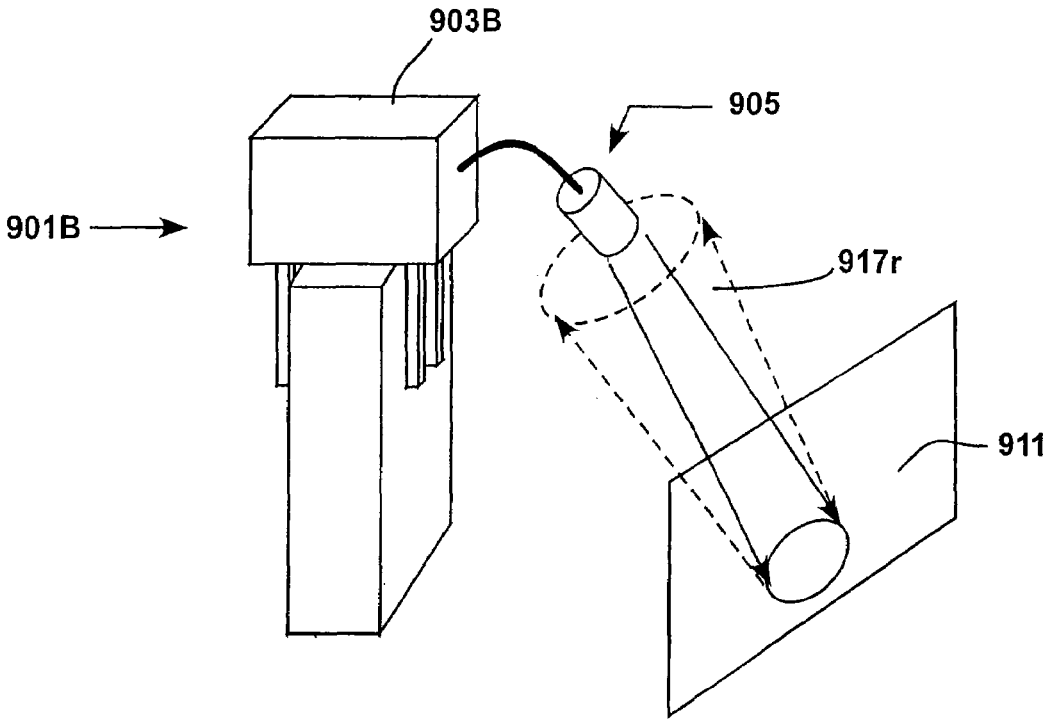

In yet other exemplary embodiments of the present invention, rather than used in the manner of a flashlight, the apparatus is adapted for operating as a monitor by use of detecting or sensing devices as a headpiece and associated circuitry. For example, as shown in FIGS. 9A and 9B, with a same basic configuration as shown in FIGS. 1 and 2, the headpiece 905, rather than incorporating a projection element, may include instead emitting, detecting, or sensing, transducer(s) or both, which either passively or actively detect the presence or change in some phenomena or object lying in the direction that the head 905 is aimed. FIG. 9A illustrates an exemplary embodiment MID 901A in which a projected energy beam 917*p* is expanding, e.g., a radar or sonar signal, and any object 907 in the path provides a return signal 917*r* that is captured. FIG. 9B illustrates an exemplary embodiment MID 901B in which the projected energy beam is focused, e.g., a laser spot on object 911, and the return signal 917*r* is spreading and capturable. Incorporated into the main body 903A may be respective associated, respectively generally known manner circuitry to operate with these types of transducers. FIG. 8A (Prior Art) is a circuit block diagram of an exemplary embodiment of such circuitry.

Examples of headpiece 905 transduction elements for emitter-detector implementations include, but since many adaptations are possible depending on intended use of a specific design implementation, are not limited to:

an infrared detector in the head to sense the temperature of some object in the beam (see figure illustrating emissions or reflectance radiating from some region in the illumination beam back to the head);

an ultraviolet light detector to detect ultraviolet emission from a specific material with response to high-energy illumination at a longer wavelength; and an sonar, ultrasound, microwave, or other electromagnetic spectrum may be emitted and received in a continuous or pulsed energy form in the direction of the beam pattern in order to detect the presence of an object, motion of an object, or the distance of an object from the head.

A dual-head unit may also be implemented. For example, one transducer element might be incorporated in one head for emitting the interrogation energy and a receiving transducer in the other head for detecting the scattered energy. Also, multipurpose implementations may be implemented. For example, embodiment, one headpiece 105 (FIG. 2) may be an active illumination device—e.g., emitting white light—and the other 905 (FIGS. 9A, 9B) may be a motion detecting type device which in a known manner turns on the active visible light illumination.

It is to be understood also that such an MID unit could also include an signaling connection or a connection by telemetry to a remote site for processing and using the detected information.

In summary, integration of the universality features of the clamping mechanisms, the tractable and retractable head with the mechanisms for turning and aligning it on a specific region, combined with the main body for batteries and electronics and a head which emits light useful for illuminating, monitoring, and visualizing its alignment all make the system a highly useful combination for portable sensing purposes.

The foregoing Detailed Description of exemplary and preferred embodiments is presented for purposes of illustration and disclosure in accordance with the requirements of the law (subtitles are included for reference only and are not intended as any limitation on the scope of the invention nor should any be implied therefrom). It is not intended to be exhaustive nor to limit the invention to any precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . "

What is claimed is:

1. A mobile illumination apparatus comprising:

means for mounting at least one illumination device such that the illumination device is extendible and directable for directing said illumination device toward a predetermined point-of-interest which lies at any position within a region defined as substantially a sphere having said apparatus central thereto; and means for clamping said illumination device to an object, wherein said means for clamping is manually adjustable and automatically locking over a span defined by a first limited range-of-motion biased-clamp and a second limited range-of-motion sliding-clamp wherein the range-of-motion of said second sliding-clamp is greater than the range-of-motion of said first sliding-clamp, and wherein said means for clamping is retractable into said apparatus.

2. A mobile illuminating apparatus (101) including means for releasably affixing said apparatus to an external object wherein said object may be irregular in shape, the apparatus comprising:

at least one head piece (105) having at least one illumination element (107);

a clamping subsystem including a first clamping member (411) on a biased (417, 418) mount to said apparatus and a second clamping member (415) on a selectively movable and selectively releasable, locking mount to said apparatus, such that said second clamping member engages a surface of an external object and forces at least a segment of said object against the first clamping member and automatically locks into a releasable position securing said apparatus to said object; and an extendable-retractable neck piece (115) having said head piece mounted on an extendable first end thereof and configured to turn each illumination element ON upon any extraction of the neck piece from the apparatus and turn each illumination element OFF only upon substantially full retraction of the neck piece into the apparatus.

3. The apparatus as set forth in claim 2 wherein the illumination element is selected from a group including visible light emitting diodes, visible light receiving sensors, invisible light wavelength emitting devices, invisible light wavelength sensing devices, laser light emitting devices, laser light sensing devices, sound transducers, ultrasound transducers, electromagnetic wave transducers, microwave emitters, microwave receivers, and fiber optic devices.

4. The apparatus as set forth in claim 3 wherein said headpiece includes more than one said illumination element selected from said group.

5. The apparatus as set forth in claim 4 wherein a first said element is a transmitting device and a second said element is a receiving device for intercepting reflected illumination from an object intercepting projected illumination from said transmitting device.

6. The apparatus as set forth in claim 2 further comprising: a power source including at least one battery, and circuitry for driving each said illumination element wherein said circuitry includes sub-circuitry for compensating for battery power drain.

7. The apparatus as set forth in claim 6 wherein said headpiece is replaceable and further comprises an electrical signal feedback device (R2) connected to said circuitry and selected to have operating characteristics such that at a desired drive electrical current, voltage across the electrical signal feedback device is equal to trip point level for the illumination element of the headpiece.

8. The apparatus as set forth in claim 2 wherein when said apparatus is clamped to said external object, said illumination element is selectively positionable for directing said projected illumination toward a predetermined area-of-interest which lies in a position within a region defined as greater than a hemisphere having a diametrical axis defined by a point along a longitudinal axis of said device.

9. The apparatus as set forth in claim 2 wherein when said apparatus is clamped to said external object, said illumination element is selectively positionable such that the headpiece (105) may be positioned to shine in any direction of a spherical construct having the MID (101) at the general center of the sphere.

10. The apparatus as set forth in claim 2 wherein a plurality of headpieces are incorporated wherein each headpiece includes a transducing element having differing operational characteristics.

11. A mobile illuminating device (101) comprising:

case means (103) for housing components of said illuminating device;

within said case means, battery means (307) for providing electrical power, coupled to said battery means, circuit means (303, 801) for controlling said electrical power, transducing means (105, 107) for converting said electrical signals from said circuit means into projected illumination, wherein said transducing means is selectively extendable from said case means and retractable substantially into said case means and is selectively positionable for directing said projected illumination onto an area-of-interest;

flexible connector means (327) for electrically connecting said circuit means and said transducing means; and clamping means for selectively attaching said device to an external object (111), said clamping means including a first clamp member having at least one first clamping finger extending outwardly from said case means and a biased mount for mounting said first clamping finger to said case means such that pressure on said first clamping finger in a first direction causes the biased mount to exert a force in a second direction substantially opposite to said first direction, and a second clamp member having at least one second clamping finger extending outwardly from said case means in substantially parallel plane to and in a configuration substantially directly opposing said first clamping finger and a selectively movable, automatic locking mount for mounting said second clamping finger to said case means such that said second clamping finger is selectively slidable toward and away from said first clamping finger and wherein when both said first clamping finger and said second clamping finger are in contact with said object, said second clamping finger locks automatically into a releasable position such that said external object exerts said pressure on said first clamping finger, wherein said clamping means hold said device in a substantially fixed position regardless of shape of said external object.

12. The mobile illuminating device as set forth in claim 11 wherein said transducing means further comprises:

means for receiving reflected illumination from an object intercepting said projected illumination.

13. In combination with a mobile illumination apparatus, mounting subsystems comprising:

a extendible-retractable energy transducer support subsystem, the subsystem having and extendible-retractable support having, at least one transducer head mounted on one end of the support and an ON-OFF switch mounted on a substantially opposite end thereof, such that extending said support along substantially any length of extension range thereof from the apparatus turns said transducer head ON and substantially completely retracting said support into the apparatus turns said transducer head OFF; and a clamping mechanism, including a first mount having a first range of limited motion in a first plane wherein said first mount is biased against said limited motion in the first plane, and at least one first clamping protrusion extending outwardly in a second plane substantially perpendicular to said first plane, and a second mount having a second range of limited motion in said first plane such that said second mount is selectively movable toward and away from said first mount, at least one second clamping protrusion extending outwardly in a plane substantially parallel to said second plane, and an automatic and releasable locking mechanism such that when said first clamping protrusion is in contact with an object of substantially any shape to which the apparatus is to be clamped and said second clamping protrusion is in contact with said object on a substantially opposite from said first clamping protrusion, said apparatus is automatically releasably locked to said object.

* * * * *